US008867950B2

(12) United States Patent
Uetake et al.

(10) Patent No.: US 8,867,950 B2
(45) Date of Patent: Oct. 21, 2014

(54) WET-TYPE IMAGE FORMING APPARATUS

(75) Inventors: Shigeo Uetake, Takatsuki (JP); Junya Hirayama, Takarazuka (JP); Yuji Kamoda, Ibaraki (JP); Toshiya Natsuhara, Takarazuka (JP)

(73) Assignee: Konica Minolta Business Technologies, Inc. (JP)

( * ) Notice: Subject to any disclaimer, the term of this patent is extended or adjusted under 35 U.S.C. 154(b) by 77 days.

(21) Appl. No.: 13/416,095

(22) Filed: Mar. 9, 2012

(65) Prior Publication Data

US 2012/0237265 A1 Sep. 20, 2012

(30) Foreign Application Priority Data

Mar. 16, 2011 (JP) ..... 2011-057902

(51) Int. Cl.
*G03G 21/20* (2006.01)
*G03G 15/20* (2006.01)

(52) U.S. Cl.
CPC ..... *G03G 15/2021* (2013.01)
USPC ..... 399/92

(58) Field of Classification Search
USPC ..... 399/57, 92
See application file for complete search history.

(56) References Cited

U.S. PATENT DOCUMENTS

| | | | | |
|---|---|---|---|---|
| 5,424,813 | A * | 6/1995 | Schlueter et al. | 399/239 |
| 5,916,718 | A * | 6/1999 | Kellie et al. | 430/45.2 |
| 2001/0017997 | A1 * | 8/2001 | Saitoh | 399/250 |
| 2006/0133853 | A1 * | 6/2006 | Kim et al. | 399/251 |

FOREIGN PATENT DOCUMENTS

| | | | |
|---|---|---|---|
| JP | 49-22146 | | 2/1974 |
| JP | 56-96459 | U | 7/1981 |
| JP | 11-15314 | A | 1/1999 |
| JP | 11-194621 | A | 7/1999 |
| JP | 11-272079 | A | 10/1999 |
| JP | 2000-3061 | A | 1/2000 |
| JP | 2007-163777 | A | 6/2007 |
| JP | 2009-163065 | A | 7/2009 |

OTHER PUBLICATIONS

Notice of Grounds of Rejection for Japanese Patent Application No. 2011-057902, mailed Apr. 8, 2014, with English translation.

* cited by examiner

*Primary Examiner* — Walter L Lindsay, Jr.
*Assistant Examiner* — Frederick Wenderoth
(74) *Attorney, Agent, or Firm* — Cantor Colburn LLP

(57) ABSTRACT

A wet-type image forming apparatus includes: a heating unit configured to heat a recording medium and to volatilize liquid carrier in a toner image; a fixing unit configured to fix the toner image on the recording medium and disposed at a downstream side of the heating unit in a conveyance direction of the recording medium; a conveyance unit configured to convey the recording medium from the heating unit to the fixing unit; and a housing disposed to cover the conveyance unit, wherein the recording medium is conveyed on the conveyance unit in the housing toward the fixing unit after heated by the heating unit, in the presence of gas containing the volatilized liquid carrier, and the volatilized liquid carrier is cooled and turned into fine mist liquid carrier and then the fine mist liquid carrier attaches to the recording medium before the recording medium reaches the fixing unit.

18 Claims, 4 Drawing Sheets

WET-TYPE IMAGE FORMING APPARATUS

This application is based on Japanese Patent Application No. 2011-057902 filed with the Japan Patent Office on Mar. 16, 2011, the entire content of which is hereby incorporated by reference.

BACKGROUND OF THE INVENTION

1. Field of the Invention

The present invention relates to an image forming apparatus of electrophotographic type such as a copier, a printer, or a facsimile, in particular, relates to a wet-type image forming apparatus configured to form a toner image using liquid developer.

2. Description of the Related Art

In an image forming apparatus of electrophotographic type, an electrostatic latent image on a photoconductor is developed with toner using a developing device. The electrostatic latent image thus developed on the photoconductor is transferred onto a recording sheet or the like, thereby forming an image thereon. For such a process of transfer in the image forming apparatus, an electrostatic transfer method is generally employed.

When transferring the toner image onto a sheet, which is a target of the transfer, a voltage is applied using a transfer roller or the like from the underside of the sheet provided to face the photoconductor so as to form an electric field between the photoconductor and the recording sheet, thereby electrostatically attaching the toner image onto the recording sheet by means of this electric field.

Thereafter, the fixing device applies heat and pressure to the recording sheet, thereby fixing the transferred toner image onto the recording sheet.

Meanwhile, in recent years, a wet-type image forming apparatus has been known as an image forming apparatus required to achieve higher image quality and higher resolution such as an office printer for a massive amount of printing or an on-demand printing device. The wet-type image forming apparatus employs liquid developer which contains small-size toner particles and allows for less disturbance of a toner image. In the liquid developer thus employed, toner particles are dispersed in a liquid carrier of paraffin-base solvent or the like. In the steps of development and transfer, the toner particles are moved as a result of migration caused by an electric field in a toner layer constituted by the liquid carrier and the toner particles, thereby transferring the image onto the recording sheet.

In the wet-type image forming apparatus employing the liquid developer, the liquid carrier in the toner layer needs to be removed to attain secure fixing.

The liquid carrier in the toner layer is removed by volatilization thereof, removal thereof at the fixing member, penetration thereof into the sheet. However, it is known that when the toner layer with a small amount of the liquid carrier comes into contact with the fixing rollers, "offset", which is a phenomenon in which toner particles are attached to the surface of a fixing roller, is likely to take place.

To address this, Japanese Laid-Open Patent Publication No. 11-194621, Japanese Laid-Open Patent Publication No. 11-272079, or Japanese Laid-Open Patent Publication No. 2000-003061 proposes a method of suppressing the offset by impregnating a recording sheet with a nonvolatile liquid carrier, which serves as a release agent.

In addition, Japanese Laid-Open Patent Publication No. 2007-163777 discloses a method of suppressing the offset by adjusting an amount of a nonvolatile liquid carrier to be removed using a roller coming into contact with the toner layer, before transferring onto the recording sheet.

However, in each of the above-described methods, the nonvolatile liquid carrier remains in the recording sheet. Even in the method of Japanese Laid-Open Patent Publication No. 2007-163777, the liquid carrier in the recording sheet is not completely removed. Hence, even though the offset can be suppressed, the liquid carrier thus remaining serves to inhibit the fixing. Thus, it is difficult to achieve both the suppressed offset and the secure fixing.

SUMMARY OF THE INVENTION

The present invention has been made to solve the foregoing problem, and has its object to provide a wet-type image forming apparatus capable of achieving both suppression of offset and secure fixing.

A wet-type image forming apparatus according to an aspect of the present invention is a wet-type image forming apparatus using liquid developer containing liquid carrier and toner particles dispersed in the liquid carrier. The wet-type image forming apparatus includes: a heating unit configured to heat a recording medium and to volatilize liquid carrier in a toner image formed by development using the liquid developer and transferred to the recording medium; a fixing unit configured to fix the toner image on the recording medium and disposed at a downstream side of the heating unit in a conveyance direction of the recording medium; a conveyance unit configured to convey the recording medium from the heating unit to the fixing unit; and a housing disposed to cover the conveyance unit. The recording medium is conveyed on the conveyance unit in the housing toward the fixing unit after heated by the heating unit, in the presence of gas containing the volatilized liquid carrier, and the volatilized liquid carrier is cooled and turned into fine mist liquid carrier and then the fine mist liquid carrier attaches to the recording medium before the recording medium reaches the fixing unit.

A wet-type image forming apparatus according to another aspect of the present invention is a wet-type image forming apparatus using liquid developer containing liquid carrier and toner particles dispersed in the liquid carrier. The wet-type image forming apparatus includes: a heating unit configured to heat a recording medium and to volatilize liquid carrier in a toner image formed by development using the liquid developer and transferred to the recording medium; a fixing unit configured to fix the toner image on the recording medium, and disposed at a downstream side of the heating unit in a conveyance direction of the recording medium; a conveyance unit configured to convey the recording medium from the heating unit to the fixing unit; and a guide member disposed to cover the conveyance unit to form a passage in which the volatilized liquid carrier moves in the conveyance direction of the recording medium. The recording medium is conveyed on the conveyance unit toward the fixing unit after heated by the heating unit, and the volatilized liquid carrier is cooled and turned into fine mist liquid carrier during the movement, and then the fine mist liquid carrier attaches to the recording medium before the recording medium reaches the fixing unit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
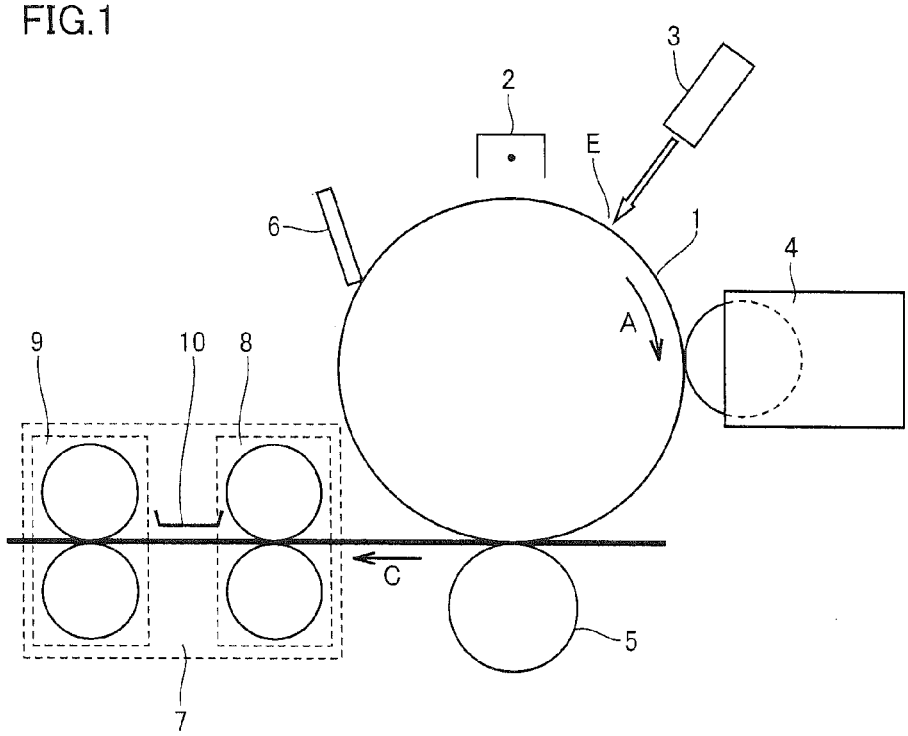
FIG. 1 illustrates a configuration of a major portion of a wet-type image forming apparatus in an embodiment of the present invention.

The following describes an embodiment of the present invention with reference to figures. In the description below, the same parts and components are given the same reference characters and are assumed to have the same names and the same functions.

FIG. 1 illustrates a configuration of a major portion of a wet-type image forming apparatus in the embodiment of the present invention.

Referring to FIG. 1, the image forming apparatus according to the embodiment of the present invention performs image formation by forming a toner image on an image holding unit (photoconductor) 1 in accordance with an electrophotographic method, transferring the toner image onto a medium such as a recording sheet, and fixing it thereonto. In this way, the toner image is fixed.

This image forming apparatus has photoconductor 1 serving as the image holding unit for holding an image. Provided around photoconductor 1 are a charging device 2, an exposure device 3, a liquid developing device 4, a transfer roller 5, and a cleaner 6 in this order in a rotation direction A of photoconductor 1.

Photoconductor 1 is charged by charging device 2 and is then exposed to light by exposure device 3 at a location E in the figure, thereby forming an electrostatic latent image on the surface of photoconductor 1. Exposure device 3 includes a laser light generator or the like.

Liquid developing device 4 develops the electrostatic latent image using toner in liquid developer containing a liquid carrier in which electrically charged toner particles are dispersed. Accordingly, a toner image is formed on photoconductor 1.

Transfer roller 5 transfers the toner image thus formed on photoconductor 1, onto the recording sheet. The recording sheet thus having the toner image transferred is conveyed in a direction C indicated by an arrow in the figure. The toner image on the recording sheet is fixed by fixing device 7, and then the recording sheet is ejected from the wet-type image forming apparatus.

Cleaner 6 removes toner remaining on photoconductor 1 after the transfer, with mechanical force.

Any well-known electrophotographic techniques can be used for photoconductor 1, charging device 2, exposure device 3, liquid developing device 4, transfer roller 5, cleaner 6, and the like in the image forming apparatus.

In this example, it has been illustrated that the toner image formed on photoconductor 1 is transferred onto the recording sheet but the toner image formed on the image holding unit serving as photoconductor 1 may be transferred onto the recording sheet via an intermediate transfer member.

In the wet-type image forming apparatus employing the liquid developer, the toner layer developed on photoconductor 1 by liquid developing device 4 is constituted by the toner and the liquid carrier, and is transferred onto the recording sheet by the transfer roller. On this occasion, the liquid carrier is transferred onto the recording sheet together with the toner, and then the recording sheet therewith is conveyed to fixing device 7.

Fixing device 7 is provided with a plurality of heating units including heat/pressure applying units 8, 9 in order to remove surplus liquid carrier and attain sufficient fixing strength. A configuration of the fixing device will be described later.

The following describes the liquid developer used for the development. In the liquid developer, colored toner particles are dispersed at a high concentration in the liquid carrier serving as a solvent. Further, appropriately selected agents such as a dispersing agent and a charge control agent may be added to the liquid developer.

In other words, the liquid developer mainly contains an insulative liquid serving as the liquid carrier and the toner for developing the electrostatic latent image.

The liquid carrier is not particularly limited as long as it is a liquid carrier generally used for an electrophotographic liquid developer. Examples thereof include: an isoparaffin-base Isopar (G, H, L, M or the like) provided by ExxonMobil; an IP solvent (1620, 2028, 2835, or the like) provided by Idemitsu Kosan Co., Ltd.; and paraffin-base MORESCO-White (P-40, P-70, P-120) provided by MATSUMURA OIL RESEARCH CORP. Alternatively, usable examples thereof include: silicon oil and mineral oil.

The toner particles are mainly made of a resin and a pigment or a dye for coloring. The resin has a function of uniformly dispersing the pigment or the dye in the resin, and also has a function as a binder when fixing onto the recording sheet.

The toner particles are not particularly limited as long as they are toner particles generally used for an electrophotographic liquid developer. Examples of the binder resin for the toner include thermoplastic resins such as a polystyrene resin, an acrylic styrene resin, an acrylic resin, a polyester resin, an epoxy resin, a polyamide resin, a polyimide resin, and a polyurethane resin. A plurality of resins among these resins can be used in combination.

For the pigment or the dye for coloring the toner, a commercially available pigment or dye can be employed. Examples of the pigment include: carbon black, iron red, titanium oxide, silica, phthalocyanine blue, phthalocyanine green, sky blue, benzidine yellow, lake red D, and the like. Examples of the dye include: solvent red 27, acid blue 9, and the like.

The liquid developer can be prepared based on a generally employed method. An exemplary method is as follows. That is, the binder resin and the pigment in a predetermined blending ratio are melted and kneaded using a pressure kneader, a roller mill, or the like so as to attain uniform dispersion. Then, the dispersion thus obtained is pulverized into fine particles using, for example, a jet mill. The fine particles thus obtained are classified using, for example, an air classifier, thereby obtaining colored toner particles having a predetermined size. The toner particles thus obtained are mixed with the insulative liquid serving as the liquid carrier in a predetermined blending ratio. The particles are dispersed uniformly in the mixture using dispersing means such as a ball mill, thus obtaining the liquid developer.

Because the wet-type image forming method is employed, the toner particles desirably have an average particle size of 0.1 μm to 5 μm. When the average particle size is less than 0.1 μm, the development property is greatly decreased. On the other hand, when the particle size is larger than 5 μm, the image quality is decreased.

A ratio of mass of the toner particles to mass of the liquid developer is appropriately 10% to 50%.

When the ratio is less than 10%, the toner particles are likely to settle out, which leads to a problem in stability with passage of time in a long-term storage. In addition, a large amount of the liquid developer needs to be supplied to obtain a required image density, which results in increased amount of the liquid carrier attached to the recording sheet. This may lead to a problem in handling vapor resulting from drying during the fixing. On the other hand, when the ratio is greater than 50%, the viscosity of the liquid developer becomes too high, which makes it difficult to handle it in production thereof.

The viscosity of the liquid developer is desirably not less than 0.1 mPa·s and not more than 10000 mPa·s at 25° C. A viscosity falling below 0.1 mPa·s leads to a low toner concentration and deteriorated stability in dispersion of the toner particles. This makes it difficult to form a thin layer during the development. On the other hand, a viscosity exceeding 10000 mPa·s makes it difficult to handle stirring, supply, and the like of the liquid developer, with the result that a large burden is likely to be imposed on the device in supplying the liquid developer uniformly.

Figure 2:
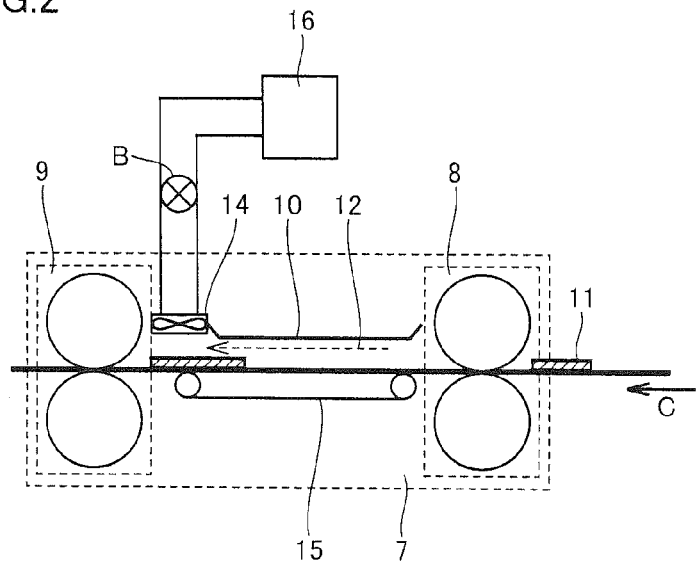
FIG. 2 illustrates a configuration of a fixing device in the embodiment of the present invention.

FIG. 2 illustrates a configuration of the fixing device in the embodiment of the present invention.

Referring to FIG. 2, as one example, fixing device 7 in the embodiment of the present invention is provided with heat/pressure applying unit 8 serving as a heating unit disposed at the upstream side relative to a fixing unit, and heat/pressure applying unit 9 serving as the fixing unit.

In the present example, a pair of rollers are exemplified as each of heat/pressure applying units 8, 9, but the present invention is not limited to this. One or both of heat/pressure applying units 8, 9 may be constituted by belt member(s).

Between heat/pressure applying units 8, 9, a conveyance belt 15 and a guide member 10 are provided. Conveyance belt 15 is configured to convey the recording sheet. Guide member 10 is disposed along and above conveyance belt 15.

When conveying the recording sheet, airflow 12 is formed between the conveyance unit and the guide member in a direction from heat/pressure applying unit 8 at the upstream side in the conveyance direction to heat/pressure applying unit 9 at the downstream side.

Further, an exhausting unit 14 serving as an airflow forming part connected to a vapor recovery device 16 is provided near heat/pressure unit 9 to achieve stronger airflow 12. Here, an openable/closable valve B is provided. By opening valve B, exhausting unit 14 and vapor recovery device 16 are connected to each other to provide an exhausting passage, whereby gas carried by airflow 12 is exhausted toward vapor recovery device 16. For exhausting unit 14, a fan or the like can be used, for example.

Vapor recovery device 16 separates and recovers surplus volatilized liquid carrier included in the exhausted gas. Accordingly, the volatilized liquid carrier can be prevented from spreading in a room.

The recording sheet to which toner layer 11 including the liquid carrier has been transferred by transfer roller 5 is conveyed to and is heated by heat/pressure applying unit 8 at the upstream side.

With the temperature of the recording sheet increased, the toner image is provisionally fixed onto the recording sheet and the liquid carrier in the toner layer and the recording sheet is volatilized, thereby removing the liquid carrier in the toner layer.

The recording sheet, which passes through heat/pressure applying unit 8 at the upstream side, is conveyed by conveyance belt 15 toward heat/pressure applying unit 9 at the downstream side.

At the same time, air including a large amount of the liquid carrier volatilized by heat/pressure applying unit 8 at the upstream side is carried in the exhausting passage, which is formed between conveyance belt 15 and guide member 10, by airflow 12 toward heat/pressure applying unit 9 at the downstream side.

Thus, the recording sheet is conveyed by conveyance belt 15 toward heat/pressure applying unit 9 at the downstream side in the presence of the air (liquid carrier gas) including the large amount of the volatilized liquid carrier.

The air including the large amount of the volatilized liquid carrier has been heated by heat/pressure applying unit 8 at the upstream side. The temperature of such air is decreased while being conveyed in the exhausting passage toward heat/pressure applying unit 9 at the downstream side.

Accordingly, a part of the volatilized liquid carrier is liquefied into fine mist of the liquid carrier (fine mist liquid carrier).

Accordingly, the fine mist liquid carrier is attached to the surface of the recording sheet conveyed by conveyance belt 15.

Thus, when the recording sheet having passed through heat/pressure applying unit 8 at the upstream side is conveyed to heat/pressure applying unit 9 at the downstream side, the recording sheet passes through the gas of liquid carrier volatilized by the heating provided by heat/pressure applying unit 8 at the upstream side, thereby cooling the volatilized liquid carrier. Accordingly, the fine mist liquid carrier is attached to the recording sheet.

In the present example, guide member 10 is disposed only between the heat/pressure applying units at the upstream and downstream sides, but the present invention is not limited to this. Guide member 10 may cover heat/pressure applying unit 8 as well, or a portion of a cover covering the entire fixing device may serve as the guide member. In other words, guide member 10 may be in any form as long as guide member 10 is capable of forming a passage for airflow flowing in the conveyance direction of the recording sheet while preventing spreading of the volatilized liquid carrier.

Figure 3:
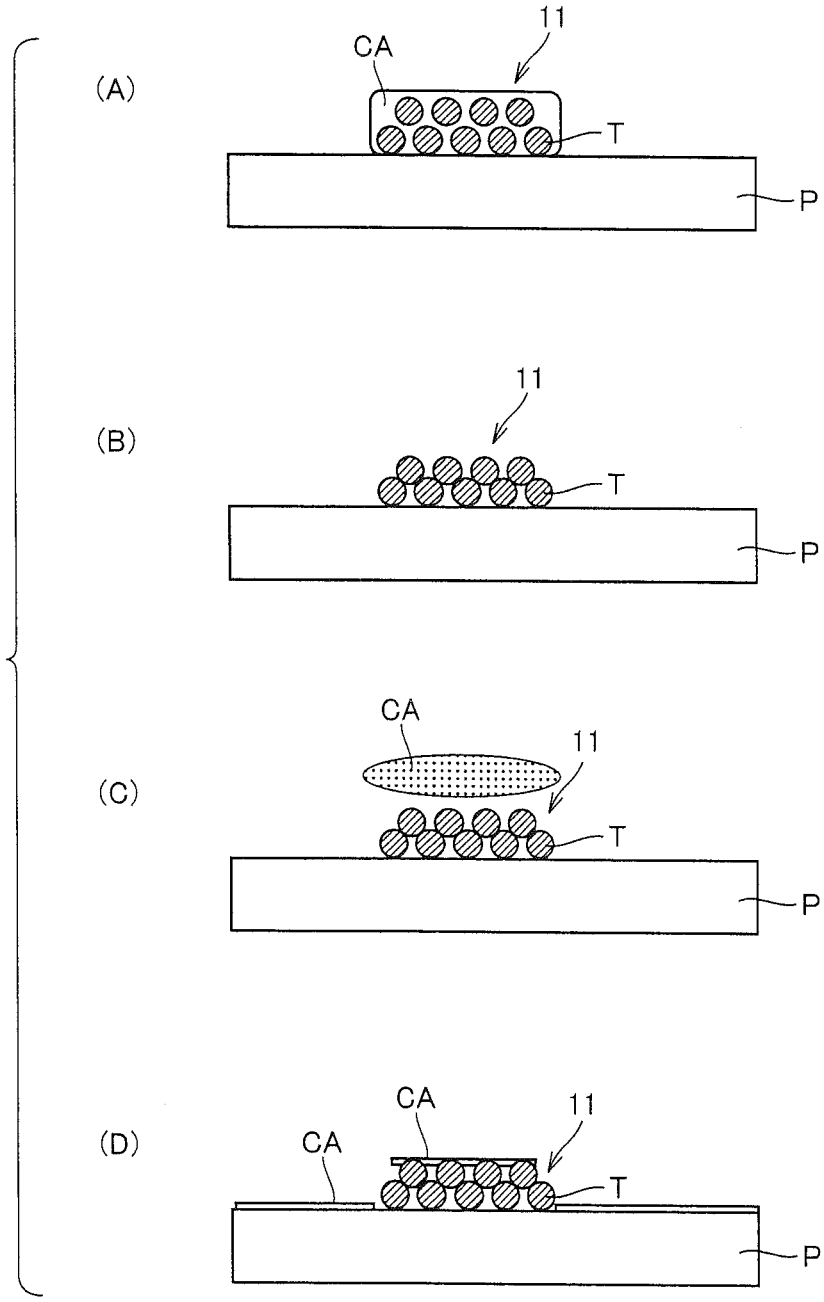
FIG. 3 schematically illustrates attachment of fine mist liquid carrier to a recording sheet P in the embodiment of the present invention.

FIG. 3 schematically illustrates the attachment of the fine mist liquid carrier to recording sheet P in the embodiment of the present invention.

Referring to FIG. 3(A), toner layer 11, which is constituted by toner particles T and liquid carrier CA, is transferred onto recording sheet P by transfer roller 5.

Then, referring to FIG. 3(B), recording sheet P passes through heat/pressure applying unit 8 at the upstream side, thereby volatilizing and therefore removing liquid carrier CA in toner layer 11 provided on recording sheet P. Accordingly, toner particles T remain thereon.

Then, referring to FIG. 3(C), liquid carrier CA thus volatilized from toner layer 11 is conveyed together with recording sheet P in the exhausting passage. During the conveyance, the temperature of volatilized liquid carrier CA is decreased and volatilized liquid carrier CA is liquefied into the fine mist of the liquid carrier (fine mist liquid carrier).

Then, referring to FIG. 3(D), a part of the fine mist liquid carrier is attached to toner particles T of toner layer 11 and the surface of recording sheet P.

Then, recording sheet P in this state is sent to heat/pressure applying unit 9 at the downstream side.

As a result, an amount of the liquid carrier in toner layer 11 becomes small. Hence, when fixing at heat/pressure applying unit 9 at the downstream side, toner particles T on recording sheet P are not prevented from being fused with each other by the liquid carrier, thus achieving sufficient fixing strength. Further, fine mist liquid carrier CA remaining on the surface of toner layer 11 serves as a parting agent (release agent) for parting toner particles T thus fused and heat/pressure applying unit 9 from each other, thereby achieving suppression of offset.

Further, the fine mist liquid carrier is also attached to the surface of recording sheet P on which no toner particles T are attached. Accordingly, a problem such as paper blister, which takes place when the recording sheet is heated too much, can be suppressed.

In FIG. 2, heat/pressure applying unit 8 is employed as the heating unit configured to heat the toner layer on the recording sheet at the upstream side, but the present invention is not limited to this. Any means may be employed as the heating unit at the upstream side as long as it is capable of heating the recording sheet having the toner layer constituted by the toner particles and the liquid carrier. Examples thereof include: radiation heating means such as an infrared heater or a xenon flash; convective heat transfer means such as hot air; and a combination thereof.

In the embodiment of the present invention, the fine mist liquid carrier generated by cooling the volatilized liquid carrier is attached to the toner layer on the recording sheet without using any liquid applying means. Hence, the image thereon is never disturbed and therefore no image defect takes place. Further, in the embodiment of the present invention, the fixing method employing the volatile liquid carrier is adopted rather than the method of impregnating the recording sheet with a nonvolatile liquid carrier. Accordingly, an image defect of strikethrough, with which an image on the front-side can be seen through when viewed from the underside thereof, can be suppressed, thereby achieving both suppression of offset and secure fixing.

Figure 4:
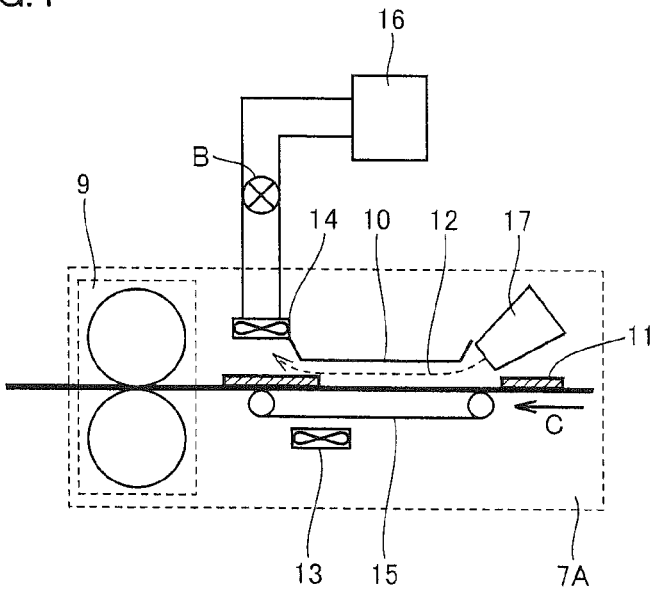
FIG. 4 illustrates a configuration of a fixing device 7A in a first variation of the embodiment of the present invention.

FIG. 4 illustrates a configuration of a fixing device 7A in a first variation of the embodiment of the present invention.

Referring to FIG. 4, the following describes a configuration that employs a means for heating through convective heat transfer using hot air.

Fixing device 7A in the first variation of the embodiment of the present invention is configured to be provided with a hot air generating device 17 as the heating unit disposed at the upstream side relative to the fixing unit instead of heat/pressure applying unit 8.

As with the above-described embodiment, hot air is applied to the recording sheet by hot air generating device 17, and the liquid carrier is volatilized from the toner layer on the recording sheet by hot air generating device 17.

Between hot air generating device 17 thus serving as the heating unit and heat/pressure applying unit 9 serving as the fixing unit, conveyance belt 15 and the guide member 10 are provided. As with the example of FIG. 2, conveyance belt 15 is configured to convey the recording sheet and the guide member 10 is disposed along conveyance belt 15. Likewise, exhausting unit 14 and recovery device 16 are also provided in the same manner as in fixing device 7 shown in FIG. 2. Airflow 12 is made stronger by not only exhausting unit 14 but also the hot air coming from hot air generating device 17.

In the case where the hot air is employed as the heating unit at the upstream side, toner layer 11 on the surface of the recording sheet is exposed thereto without any blockage while being heated. Hence, the liquid carrier is readily volatilized. Further, the convection of the volatilized liquid carrier near the surface of the recording sheet can be facilitated, whereby the vapor pressure of the liquid carrier can be maintained low. Accordingly, further volatilization can be facilitated.

Although the volatilization of the liquid carrier is facilitated by using hot air generating device 17 as the heating unit at the upper stream side, the heating with the hot air provides heat transfer efficiency lower than that in the contact heating. Hence, the temperature of the hot air needs to be set high. As one example, the temperature of the hot air is desirably set in a range of 150° C. to 300° C. in consideration of heat resistance of the recording sheet.

Accordingly, the temperature of the gas including the volatilized liquid carrier flowing along the recording sheet also becomes higher than that in the case of contact heating. In addition, the vapor pressure of the liquid carrier is low. Hence, it is considered that the volatilized liquid carrier may be less likely to be liquefied (formed into fine mist).

In view of this, in order to form the volatilized liquid carrier into the fine mist in the vicinity of the recording sheet, a cooling system 13 may be provided at conveyance belt 15 to decrease the temperature of airflow 12 near the recording sheet. Specifically, cooling system 13 that uses a fan is provided to face the underside of the recording sheet.

By cooling conveyance belt 15 by cooling system 13, the recording sheet is cooled from an underside, that is opposite to a surface of the recording sheet on which the toner image is carried, to decrease the temperature of the gas including the large amount of the volatilized liquid carrier flowing along the recording sheet, even when the temperature of the gas including the large amount of the volatilized liquid carrier is high. Accordingly, a part of the volatilized liquid carrier can be liquefied and formed into the fine mist of the liquid carrier (fine mist liquid carrier), and can be attached to the recording sheet.

Because the temperature of the gas including the large amount of the volatilized liquid carrier is decreased by cooling conveyance belt 15 using cooling system 13 to cool the underside of the recording sheet in contact with conveyance belt 15, i.e., because a part of the volatilized liquid carrier is liquefied near the recording sheet, the liquefied carrier can be suppressed from being attached to guide member 10.

It should be noted that cooling system 13 is provided in the present example, but is not essential and may not be provided. Further, cooling system 13 may be applied to the configuration shown in FIG. 2.

In the configuration of FIG. 4, the means for air-cooling conveyance belt 15 is provided as cooling system 13, but cooling system 13 may be configured to cool a driving roller in the conveyance belt or may be configured to directly air-cool the recording sheet, for example.

Figure 5:
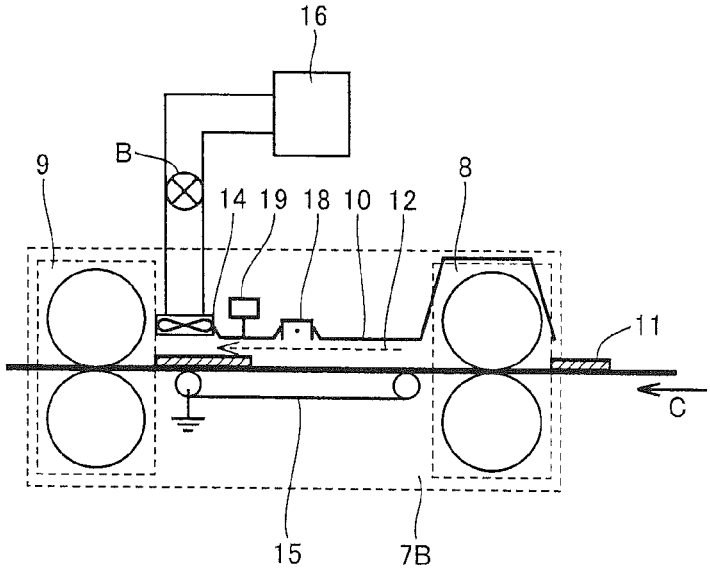
FIG. 5 illustrates a configuration of a fixing device 7B in a second variation of the embodiment of the present invention.

FIG. 5 illustrates a configuration of a fixing device 7B in a second variation of the embodiment of the present invention.

Referring to FIG. 5, in comparison to the configuration of fixing device 7 illustrated in FIG. 2, a charging unit 18 and an electric field generator 19 are provided at portions of the guide member between heat/pressure applying units 8, 9 in fixing device 7B. It is assumed that each of charging unit 18 and electric field generator 19 is connected to a power source (not shown).

An electrically conductive belt is used as conveyance belt 15 to generate an electric field between electric field generator 19 and conveyance belt 15.

Here, it is illustrated that guide member 10 is provided to cover the entire heat/pressure applying unit 8.

In this configuration, charging unit 18 charges the fine mist (fine mist liquid carrier) of the liquid carrier volatilized by heat/pressure applying unit 8 at the upstream side. The fine mist thereof has been formed from the volatilized liquid carrier during the movement along the recording sheet. It is assumed that as one example, charging unit 18 positively charges the fine mist, for example.

Further, electric field generator 19 generates an electric field between electric field generator 19 and conveyance belt 15. As one example, the electric field thus generated has a positive value at the electric field generator 19 side and has a negative value at the conveyance belt 15 side.

The fine mist liquid carrier thus charged can be electrically attracted to the recording sheet by the electric field generated between electric field generator 19 and conveyance belt 15 and can be attached to the surface of toner layer 11 on the recording sheet.

With this configuration, the fine mist liquid carrier can be more securely attached to the toner layer on the recording sheet.

In the above-described embodiment, it has been illustrated that the two heating units are employed as the fixing device, but the fixing device is not limited to the two heating units. A larger number of heating units may be provided.

Figure 6:
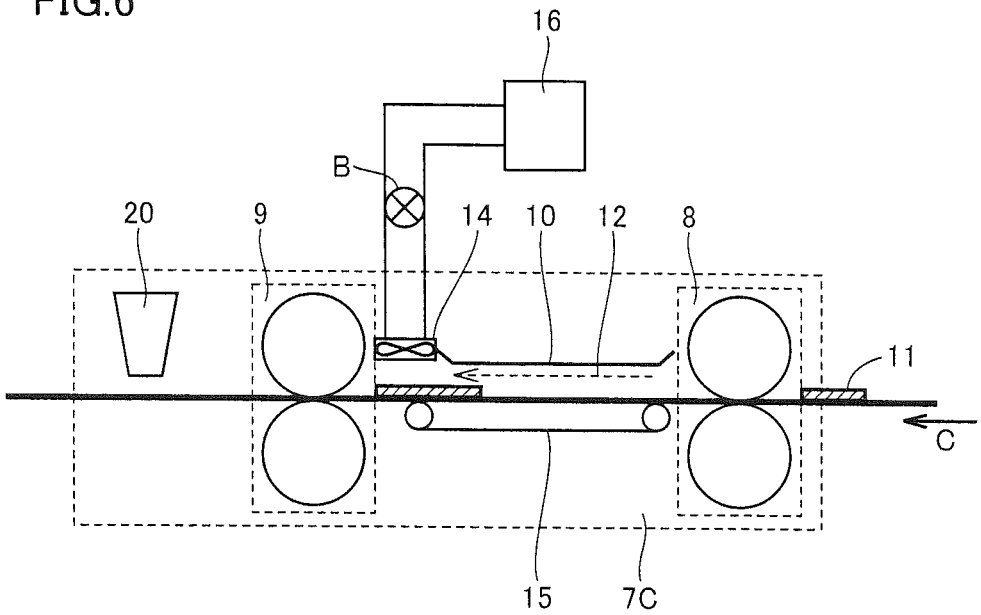
FIG. 6 illustrates a configuration of a fixing device 7C in a third variation of the embodiment of the present invention.

FIG. 6 illustrates a configuration of a fixing device 7C in a third variation of the embodiment of the present invention.

Referring to FIG. 6, in comparison to the configuration of fixing device 7 illustrated in FIG. 2, fixing device 7C is provided with a hot air generating device 20 at a stage subsequent to heat/pressure applying unit 9.

Hot air generating device 20 is configured to volatilize the liquid carrier having penetrated into the recording sheet, after the fixing.

In particular, in the case where the recording sheet is a liquid-absorbing medium, a part of the liquid carrier penetrates into the recording sheet during a period of time from the transfer of image to the conveyance of the recording sheet to the fixing device. At heat/pressure applying unit 8 of the first stage, the liquid carrier is not only volatilized but also facilitated to penetrate into the recording sheet.

The liquid carrier thus having penetrated into the recording sheet does not prevent the toner particles from being fused with each other at heat/pressure applying unit 9 of the second stage. However, it is considered that the liquid carrier remaining in the record sheet after passing through heat/pressure applying unit 9 of the second stage may cause an image defect. Specifically, the liquid carrier having penetrated into the recording sheet causes decreased light scattering property of the recording sheet, which may lead to an image defect of strikethrough with which an image on the front-side can be seen through when viewed from the underside thereof.

To address this, in the third variation of the embodiment of the present invention, hot air generating device 20 is provided to volatilize the remaining liquid carrier having penetrated into the recording sheet, after the fixing performed by heat/pressure applying unit 9. Accordingly, the liquid carrier in the recording sheet can be securely volatilized. Hence, even when a recording sheet having a high liquid-absorbing property is used as the recording sheet, the problem of the image defect of strikethrough can be solved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image forming apparatus using liquid developer containing liquid carrier and toner particles dispersed in the liquid carrier, comprising:

a heating unit configured to heat a recording medium and to volatilize liquid carrier in a toner image formed by development using the liquid developer and transferred to the recording medium;

a fixing unit configured to fix the toner image on the recording medium and disposed at a downstream side of the heating unit in a conveyance direction of the recording medium;

a conveyance unit configured to convey the recording medium from the heating unit to the fixing unit; and a housing disposed to cover the conveyance unit, wherein the recording medium is conveyed on the conveyance unit in the housing toward the fixing unit after heated by the heating unit, in the presence of gas containing the volatilized liquid carrier, and the volatilized liquid carrier is cooled and turned into fine mist liquid carrier and then the fine mist liquid carrier attaches to the recording medium before the recording medium reaches the fixing unit.

2. The wet-type image forming apparatus of claim 1, wherein the heating unit includes a pair of rollers applying pressure and heat to the recording medium.

3. The wet-type image forming apparatus of claim 1, wherein the heating unit is configured to apply hot air to the recording medium.

4. The wet-type image forming apparatus of claim 1 further comprising an airflow forming part which generates an airflow to move the gas containing the volatilized liquid carrier in the conveyance direction of the recording medium.

5. The wet-type image forming apparatus of claim 4 further comprising a recovery unit connected to the airflow forming part, wherein the recovery unit is configured to recover surplus volatilized liquid carrier.

6. The wet-type image forming apparatus of claim 1 further comprising a cooling system configured to cool the gas containing the volatilized liquid carrier.

7. The wet-type image forming apparatus of claim 6, wherein the cooling system is disposed to cool the recording medium from an underside thereof opposite to a surface thereof on which the toner image is carried.

8. The wet-type image forming apparatus of claim 7, wherein the cooling system cools the recording medium by cooling the conveyance unit.

9. The wet-type image forming apparatus of claim 1 further comprising between the heating unit and the fixing unit:

a charging unit configured to apply an electric charge to the fine mist liquid carrier; and an electric field generator configured to generate an electric field by which the fine mist liquid carrier thus fed with the electric charge attaches to the recording medium.

10. A wet-type image forming apparatus using liquid developer containing liquid carrier and toner particles dispersed in the liquid carrier, comprising:

a heating unit configured to heat a recording medium and to volatilize liquid carrier in a toner image formed by development using the liquid developer and transferred to the recording medium;

a fixing unit configured to fix the toner image on the recording medium, and disposed at a downstream side of the heating unit in a conveyance direction of the recording medium;

a conveyance unit configured to convey the recording medium from the heating unit to the fixing unit; and a guide member disposed to cover the conveyance unit to form a passage in which the volatilized liquid carrier moves in the conveyance direction of the recording medium, wherein the recording medium is conveyed on the conveyance unit toward the fixing unit after heated by the heating unit, and the volatilized liquid carrier is cooled and turned into fine mist liquid carrier during the movement, and then the fine mist liquid carrier attaches to the recording medium before the recording medium reaches the fixing unit.

11. The wet-type image forming apparatus of claim 10, wherein the heating unit includes a pair of rollers applying pressure and heat to the recording medium.

12. The wet-type image forming apparatus of claim 10, wherein the heating unit is configured to apply hot air to the recording medium.

13. The wet-type image forming apparatus of claim 10 further comprising an airflow forming part which generates an airflow to move gas containing the volatilized liquid carrier in the conveyance direction of the recording medium.

14. The wet-type image forming apparatus of claim 13 further comprising a recovery unit connected to the airflow forming part, wherein the recovery unit is configured to recover surplus volatilized liquid carrier.

15. The wet-type image forming apparatus of claim 10 further comprising a cooling system configured to cool gas containing the volatilized liquid carrier.

16. The wet-type image forming apparatus of claim 15, wherein the cooling system is disposed to cool the recording medium from an underside thereof opposite to a surface thereof on which the toner image is carried.

17. The wet-type image forming apparatus of claim 16, wherein the cooling system cools the recording medium by cooling the conveyance unit.

18. The wet-type image forming apparatus of claim 10 further comprising between the heating unit and the fixing unit:

a charging unit configured to apply an electric charge to the fine mist liquid carrier; and an electric field generator configured to generate an electric field by which the fine mist liquid carrier thus fed with the electric charge attaches to the recording medium.

* * * * *